United States Patent [19]

von Bennigsen

[11] 3,965,582

[45] June 29, 1976

[54] GUNNERY PRACTICE METHOD AND APPARATUS

[75] Inventor: Gerd von Bennigsen, Geisenbrunn, Germany

[73] Assignee: Krauss-Maffei Aktiengesellschaft, Munich, Germany

[22] Filed: June 11, 1975

[21] Appl. No.: 585,820

Related U.S. Application Data

[63] Continuation-in-part of Ser. No. 493,658, July 30, 1974, abandoned.

[30] Foreign Application Priority Data

Aug. 2, 1973 Germany ..... 2339164

[52] U.S. Cl. ..... 35/25

[51] Int. Cl.[2] ..... F41G 3/26

[58] Field of Search ..... 35/25; 273/101.1, 105.1; 356/4, 5, 152

[56] References Cited

UNITED STATES PATENTS

| | | | |
|---|---|---|---|
| 3,026,615 | 3/1962 | Aubert | 35/25 |
| 3,608,212 | 9/1971 | Lenneryd et al. | 35/25 |
| 3,609,883 | 10/1971 | Erhard | 35/25 |
| 3,698,816 | 10/1972 | Lutchansky | 35/25 UX |
| 3,820,253 | 6/1974 | Willey | 35/25 |
| 3,882,496 | 5/1975 | Lewis et al. | 35/25 X |

*Primary Examiner*—Wm. H. Grieb

*Attorney, Agent, or Firm*—Karl F. Ross; Herbert Dubno

[57] ABSTRACT

An ordnance piece is aimed at a terrain and the trajectory followed by an imaginary projectile from the ordnance piece is calculated. A range finder is sighted through a succession of points along the trajectory onto the terrain. Simultaneously the distance between a fixed reference point and each of the points through which the range finder is sighted is also calculated and these two distances are compared until the range finder gives a reading which corresponds to a point on the trajectory. This point corresponds to the intersection of the trajectory with the terrain and is marked so as to indicate where the imaginary projectile would have hit.

9 Claims, 4 Drawing Figures

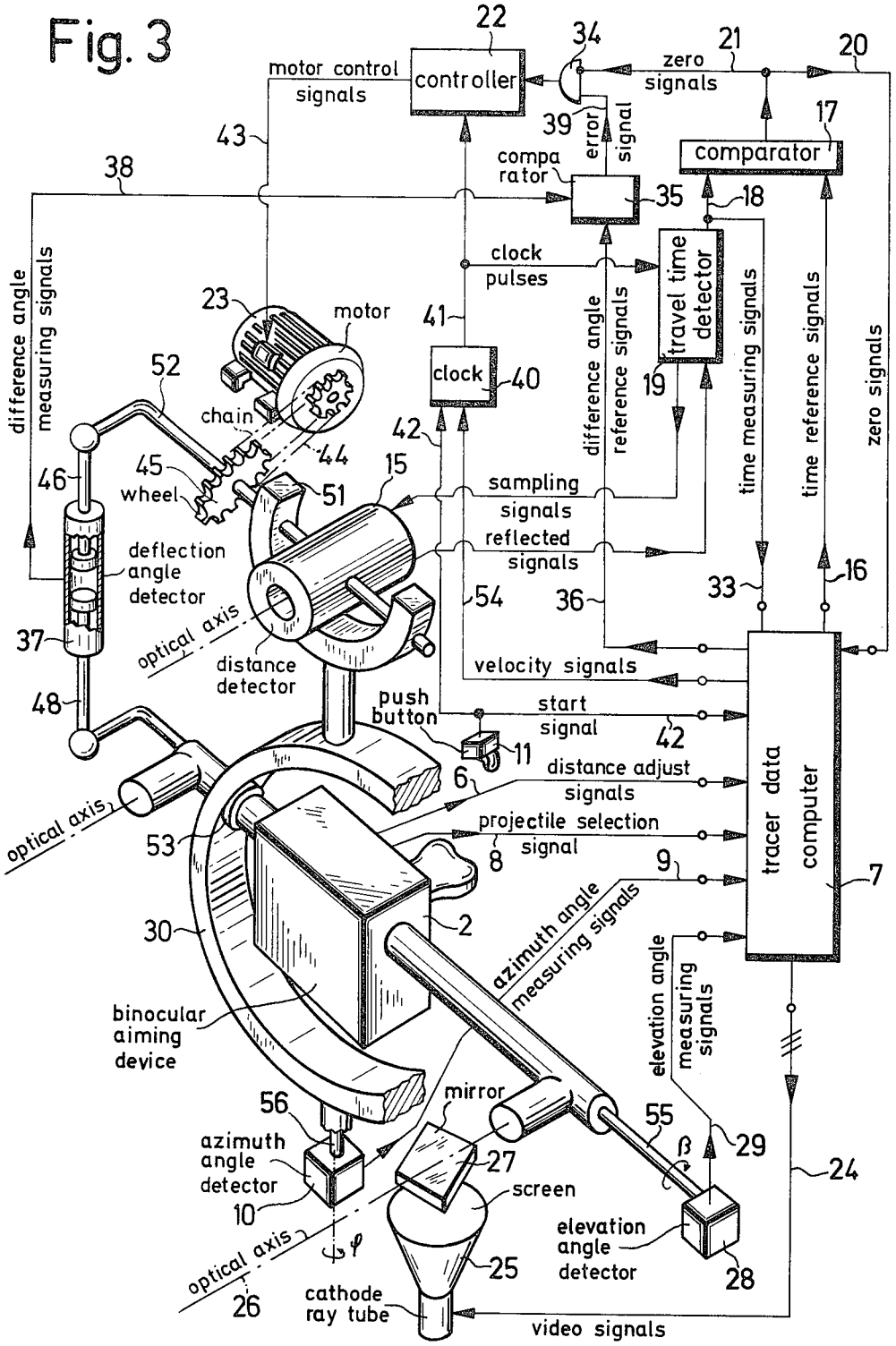
Fig. 3
controller
motor control signals
zero signals
error signal
comparator
comparator
clock pulses
travel time detector
difference angle measuring signals
difference angle reference signals
time measuring signals
time reference signals
zero signals
motor
clock
chain
wheel
deflection angle detector
optical axis
distance detector
sampling signals
reflected signals
velocity signals
push button
start signal
distance adjust signals
projectile selection signal
tracer data computer
azimuth angle measuring signals
elevation angle measuring signals
binocular aiming device
mirror
azimuth angle detector
screen
elevation angle detector
cathode ray tube
video signals

GUNNERY PRACTICE METHOD AND APPARATUS

CROSS REFERENCE TO RELATED APPLICATION

This application is a continuation-in-part of my copending patent application 493,658 filed 30 July 1974, now abandoned, for a method of and apparatus for simulating a ballistics operation.

FIELD OF THE INVENTION

The present invention relates to a method of and apparatus for simulating a ballistics operation. More particularly this invention concerns a system usable for gunnery practice and the like.

BACKGROUND OF THE INVENTION

In the training of gunnery and bombing crews it is usually particularly expensive and difficult to practice with real shells, grenades, unguided rockets and bombs, and the like so that it is necessary to provide a method of simulating the ballistic or partly ballistic operation involved. In reality before such a crew is entrusted with the actual gunnery or bombing equipment it is necessary that the various range-finding and distance-calculating equipment become wholly familiar to them so as to avoid accidents and cut costs.

Typically in a gunnery operation the target is sighted in coarsely and a first shell is fired. The trajectory of the shell is followed and the hit or impact point determined. Thereupon the cannon or the like is reaimed, taking into account the information derived from the first shot. An experienced crew frequently can hit a given target on second or third shot but an inexperienced one often wastes a multitude of such shots before coming within adequate range of the desired target.

It is known to provide a model terrain over which an imaginary projectile is fired. Such a terrain is made on a reduced scale, 1 : 200 being used frequently. The various range finders and other devices used by the practicing crew are optically altered so as to give this reduced-scale model terrain the appearance, when viewed through these devices, of a full-scale battlefield. The ordnance piece, such as a tank gun or howitzer is set up next to this model terrain and connected to a computer. A target is chosen and the piece is aimed. The range elevation and scale azimuth are fed into the computer along with the type of shell being fired. The computer then calculates the trajectory the projectile would follow. The hit location, that is the point where the trajectory intersects the surface of the terrain, is marked on the terrain by a servocontrol such as a spotlight or the like. The crew then ascertains the position of this hit with the special range finder and resets the cannon, aiming it again and starting the operation over.

In this manner it is possible for an artillery crew to obtain a great deal of experience using their ordnance piece without the necessity of discharging many projectiles. In addition it is possible for such a crew to practice regardless of weather conditions, although even adverse weather conditions can be simulated on the model terrain. The terrain can correspond to a landscape or seascape, and virtually any type of ordnance equipment can be coupled to the computer so as to allow a crew to practice.

The considerable disadvantage of this system is that a relatively large computer must be used. Thus in a system 15 meters on a side subdivided into cubes 1 cm on a side it is necessary to feed into the computer the $x$, $y$, and $z$ coordinates of the entire surface area of the terrain. This can require the storing of some 7,000,000 bits of information in the computer. Given a large enough computer it is then a relatively simple matter for it to calculate the trajectory of the imaginary shell being fired and ascertain which point on the trajectory corresponds to the point on the surface of the model terrain. The computer then directs the servocontrolled spotlight to illuminate that region which corresponds to the hit or impact point.

Such a large computer is inherently relatively expensive. Moreover it is an extremely time-consuming and difficult job to feed all of the coordinates of the surface area of the model terrain, which indeed represents a terrain 3 kilometers on a side, into the computer. Another considerable disadvantage of this system is that it is fully impossible to provide moving targets in the terrain as programming their paths of travel into the computer would further complicate the already considerable amount of information in the computer. Furthermore such a system is relatively inflexible as it eliminates the possibility of practicing with a two-part crew wherein one part merely aims and fires the ordnance piece while the other part of the crew sights the hit regions and communicates back the positions of the miss or hit, as is frequently the case in reality.

OBJECTS OF THE INVENTION

It is therefore an object of the present invention to provide an improved method of and apparatus for simulating a ballistic or partly ballistic operation.

Another object is the provision of an improved system for aiding gunnery practice by indicating the hit location of an imaginary projectile on a model terrain.

Yet another object is the provision of such a system which can use a relatively small general-duty computer which can operate with moving targets on the model terrain.

SUMMARY OF THE INVENTION

These objects are attained according to the present invention in a system wherein a trajectory signal for an imaginary projectile is generated by a computer. A range finder sights through the trajectory at the terrain and the hit location on the terrain is determined when the distance measured by the range finder through the trajectory corresponds to a point on the trajectory and is therefore at the intersection of this trajectory with the terrain.

Thus in accordance with the present invention it is not necessary to retain in the computer memory the coordinates of the surface locations on the terrain. This makes it possible to change the terrain without reprogramming the computer, and even to provide moving models on the terrain, as for instance trains or the like.

Thus in accordance with the present invention a range finder is sighted at and through the imaginary trajectory and generates a succession of outputs which correspond to the instantaneous distances through the trajectory from the range finder to an object or the like on the terrain. These outputs are continuously compared with values corresponding to the actual distance between the respective locations on the trajectory and a reference point. When the values assume a predetermined relationship the range finder is directed at that point on the imaginary trajectory which corresponds also to a point on the terrain and therefore is the intersection of this trajectory with the terrain. The hit location is then marked or illuminated so as to give the practicing crew the necessary information to reaim their cannon.

According to the present invention, therefore, values are compared so as to ascertain the intersection point of the trajectory and the terrain. One of these values corresponds to the actual distance between a reference point and a point on the terrain, this distance being on a line passing through the trajectory. The other value corresponds to a calculated distance between that point on the trajectory through which the range finder determining the first value is sighted and a reference point. The computer which generates the imaginary trajectory signal also serves to generate the actual straight-line distance between the reference point and the trajectory point through which the range finder is sighted.

According to the present invention the reference point can lie at the starting point of the trajectory, in which case the calculated value corresponds to a chord drawn from the starting point of the trajectory to successive points therealong. Such an arrangement has the further advantage that the range finder need merely swing vertically in a plane corresponding to the vertical plane of the trajectory. In most situations it has been found advantageous to limit the vertical swing of the range finder to the horizon level. When the reference point is offset from the starting point of the trajectory and the range finder is also offset therefrom it is none the less relatively simple for the trajectory-generating computer to take these offsets into account.

According to further features of this invention the projectile speed is also stored in the computer and is used as the tracking speed of the range finder along the projectile's trajectory. Thus the range finder follows the imaginary projectile at the speed which the projectile would move and the hit area is illuminated at the instant the imaginary projectile would strike. In this manner reality is duplicated as closely as possible for the crew in training. When a range finder is employed which requires a predetermined interval before being able to give a reading, this finder is sighted ahead of the imaginary projectile by a distance corresponding to the response time of the range finder.

According to yet another feature of this invention the computer is programmed to detect jumps in the distance detected by the range finder. When such a jump spans the point at which the range-finder output would indicate interception of the trajectory with the terrain surface, the apparatus will indicate that the hit location is behind a terrain feature, and therefore, not visible. In this manner a false reading is avoided as would be the case if a hill in front of the actual hit location were illuminated indicating that the hit had been there.

In accordance with yet another feature of this invention the measuring frequency of the range finder is made to increase as the intersection point is approached so as to obtain maximum sensitivity. In this manner the full capacities of the system are focused on that particular region where the impact will occur so as to obtain results of maximum sensitivity and precision.

The range finder according to the present invention can be ultrasonic or electromagnetic. It is also possible to use a laser-type range finder which can also be employed to illuminate the impact area once it is ascertained. In the latter case the surface of the model terrain is made of highly reflective material. This can be obtained by coating the terrain with particulate material of high reflectivity.

It is also possible according to the present invention to form the upper surface of the terrain as a continuously stepped surface so that in effect the entire terrain is formed of surfaces which are either horizontal or vertical, these vertical surfaces being ideally intended for reflecting the range-finder sound, electromagnetic, or light radiation.

In an arrangement where the range finder and the starting point of the trajectory are at the same location in accordance with the present invention the vertical surfaces of the stepped model terrain are made as much as possible to lie on centers of curvature to this location. Where the sending and receiving locations for the range finder are separate from one another the surfaces are made to correspond to ellipses with the two sending and receiving locations lying at the foci of these ellipses.

According to the present invention the system may also be employed outside, although the use of a model terrain allows the system to be used under any weather conditions. It is to be noted that the system according to the present invention need not have the weapon location fixed relative to the terrain, but can be moved thereabout as the particular features and coordinates of this terrain need not be held in a computer memory.

BRIEF DESCRIPTION OF THE DRAWING

The above and other objects, features and advantages will become more readily apparent from the following, reference being made to the accompanying drawing in which:

FIG. 3 is a schematic diagram of an apparatus for carrying out the method according to the present invention.

SPECIFIC DESCRIPTION

Figure 1:
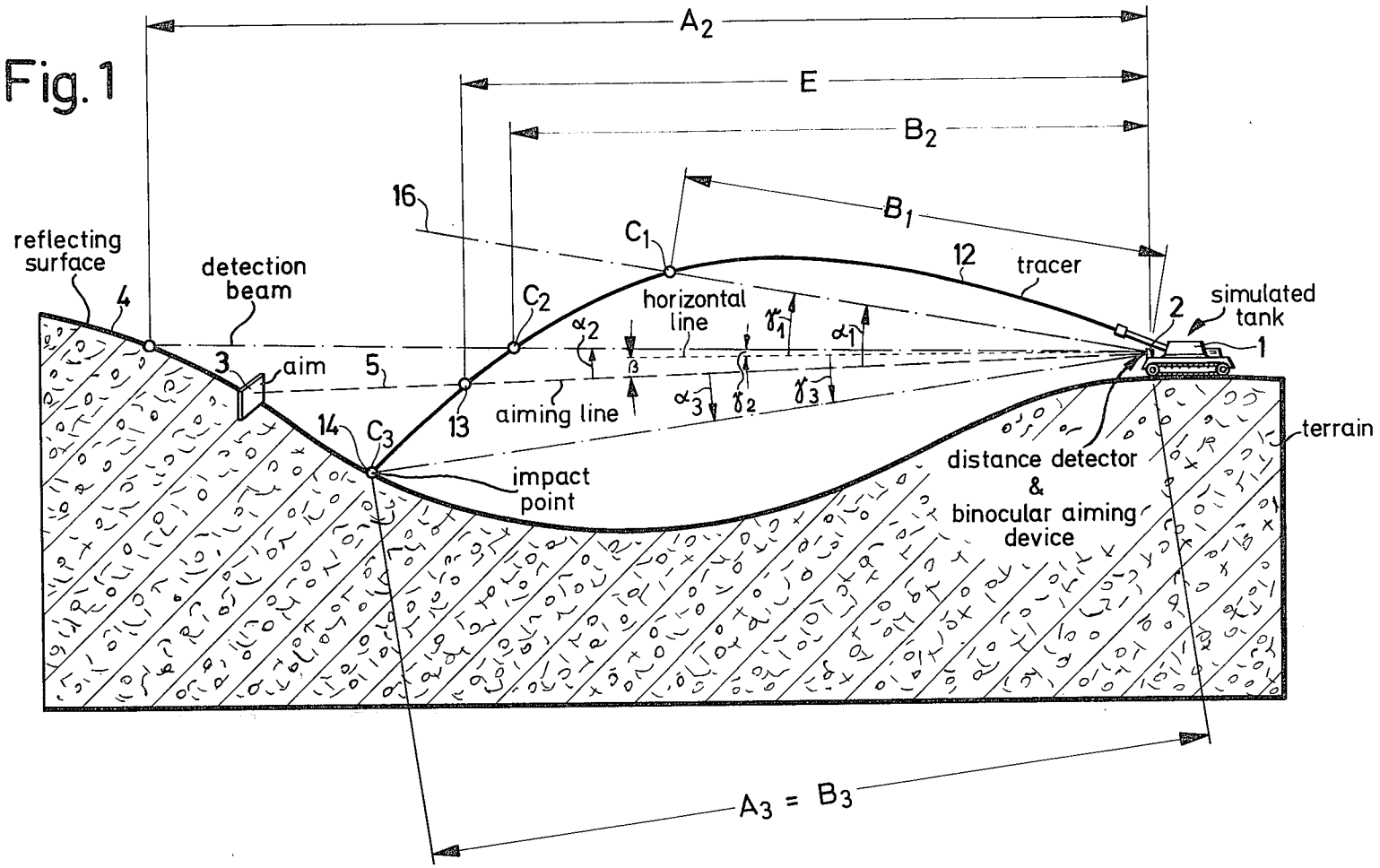
FIG. 1 is a section a a vertical plane through a shooting simulator according to the present invention wherein the intersection of the trajectory of the shot with the surface of the terrain is visible from the origin point of the shot.

FIG. 1 shows a simulated tank 1 provided with a distance detector and aiming device 2 directed at a target 3 on the reflective surface 4 of the terrain. The aiming line 5 between the device 2 and the target 3 is shown in a dashed line. A distance detector provided in the aiming device 2 measures the approximate distance E to the target 3, which is first seen not to correspond to the actual distance to the target. An electrical signal corresponding to this distance E is fed in the form of a distance adjust signal over line 4 (FIGS. 3 and 4) to a tracer data computer 7. In addition the gunner feeds to the computer 7 over line 8 a projectile selection signal corresponding to the type of imaginary shell being fired as, for instance, APDS, HEAT, or HESH/HEP. In addition the computer 7 is fed over a signal line 9 from an azimuth angle detector 10 a signal corresponding to the azimuth angle $\phi$ which tells the computer in which vertical plane the tank 1 is sighting. In a similar manner an elevation angle detector 28 (FIG. 3) feeds over line 29 to the computer 7 a signal corresponding to the elevation angle $\beta$ of the sighting device 2.

The gunner now actuates the pushbutton 11 so as to send to the computer 7 a start signal over a line 42, whereupon the computer 7 calculates an imaginary shot whose trajectory 12 is shown in FIG. 1 as a solid line. This trajectory 12 is calculated by the computer 7 based on the fed-in information concerning the azimuth angle $\phi$ the elevation angle $\beta$, the distance E, and the type of shell, and the corresponding trajectory data is fed as a video signal over a multichannel line 24 to a cathode ray readout tube 25 (FIG. 3). The trajectory 12 is projected by this tube 25 onto a semitransparent mirror 27 in the optical axis for the gunner so that he can see this trajectory. As shown in FIG. 1 the trajectory 12 intersects the sighting line or aiming line 5 at a point 13 which lies at the distance E from the aimer 2. Since this distance E does not correspond to the actual distance to the target the imaginary shot will continue on the trajectory 12 and come to land on the terrain 4 at an impact point 14.

Thereafter a range finder or distance detector 15 as shown in FIG. 3 is automatically guided along the trajectory of the imaginary shot. The range finder 15 is pivotal about a horizontal axis 52 in a gimbal-type mount 51 which is fixed on the frame 30 for the binocular aiming device 2. This frame 30 is carried on a fixed plate and is only rotatable in the azimuth direction and itself is provided with journals 53 in which the aiming device 2 is pivotal about a horizontal axis. The elevation angle detector is connected via a rod 55 lying on the horizontal pivot axis of the aimer 2 and the azimuth angle detector is connected via a similar rod 56 lying on the vertical axis for the frame 30. Thus the optical axis of the distance detector 15 always lies in the same azimuth plane as that of the binocular aiming device 2. This range finder 15 is only pivoted about its horizontal axis and is operated so as automatically to follow the path of the imaginary projectile alone its trajectory 12. The range finder 15 generates a beam 16 which follows the trajectory 12 in this manner and when this beam 16 strikes the terrain surface 4 it is reflected back into the range finder 15. $A_i$ ($i = 1, 2, 3. . . .$) between the aimer 2 and the points at which the beam 16 strikes the surface 4. In FIG. 1 three examples are shown for the distance $A_i$, namely $A_1$, $A_2$, and $A_3$, with the distance $A_1$ being infinite and the distances $A_2$ and $A_3$ being finite.

The measured distances $A_i$ are compared in accordance with the present invention with the corresponding distances $B_i$ ($i = 1, 2, 3. . . . .$) between the aimer 2 and the respective intersection point $C_i$ ($i = 1, 2, 3. . . .$) of the beam 16 and the trajectory 12. This distance $B_i$ corresponds to the length of a chord across the trajectory 12 and is fed from the computer 7 over a line 16′ in the form of a time reference signal (FIGS. 3 and 4) through a comparator 17 to which is also fed via a line 18 from the travel time detector a time measuring signal corresponding to the distance $A_i$. This comparator 17 compares the instantaneous time measuring signals with the corresponding time reference signals which are in the form of analog signals with different amplitudes or frequencies or in the form of digital signals with different numbers of bits. When the two input signals to the comparator 17 are identical, in the embodiment of FIG. 1 when $A_3$ is equal to $B_3$, the comparator 17 produces at its output a so-called null or zero signal which is fed via the line 20 to the computer 7 and over a line 21 through the inverted input of an AND gate 34. The other noninverted inpurt of the AND gate 34 is connected with the output of a further comparator 35 which is fed from the computer 7 via a line 36 with a reference signal for the angle $\alpha$ which is the difference between the sighting line 5 and the beam 16 as shown in FIG. 1 at $\alpha_1$, $\alpha_2$ and $\alpha_3$. In addition the comparator 35 receives from a deflection angle detector 37 by means of a line 38 a difference angle signal for the actual value of the instantaneous difference angle $\alpha_1$ which is subtracted from the corresponding instantaneous reference signal in the line 36. The resulting error signal is fed via line 39 to the noninverted input of the AND gate 34. So long as no zero signal is fed to the AND gate 34 from the comparator 17 the AND gate 34 conducts and transmits the error signal from the comparator 35 to a controller 22 which operates by means of a line 43 a motor 23 connected via a chain 44 to a sprocket 45 carried on the axis 52 for the distance detector 15. This controller 22 is fed with clock pulses from a line 41 from a clock 40 as is the travel time detector 19 so that the beam 16 is synchronized with imaginary calculated travel time. The clock 40 is controlled by the pushbutton 11 via line 42 and is started up at the same time that all of the other above-described operations are commenced and receives from the computer 7 by means of a line 54 signals corresponding to the velocity of the imaginary shot. Thses velocity signals control the pulse length, in systems with a constant pulse length of the pulse train produced by the clock 40. Thus the motor 23 will be operated continuously from the first instant the pushbutton 11 is actuated until a zero signal is produced in line 21. The time interval between these two instants corresponds exactly to the flight time of the imaginary shell along the imaginary trajectory 12.

Production of a zero signal on the line 21 blocks the AND gate 34 so as to stop the motor 23. In addition at this instant the computer 7, also fed the zero signal via line 20 also ceases to advance the trace of the imaginary trajectory displayed on the cathode ray tube 25 so that the gunner is given an exact picture of the trajectory 12 right up to the imaginary point on the terrain 4 and can exactly recognize where his shot would have hit. Were the trajectory 12 not cut off automatically on production of the zero signal it would simple continue and pass through the terrain so as to give a completely false idea of the impact point thereon. The gunner can then determine where his shot would have fallen, here in FIG. 1 well short of the target, and thereafter attempt a correction. The gunner may make another attempt at shooting and improve his techniques and aim.

Figure 2:
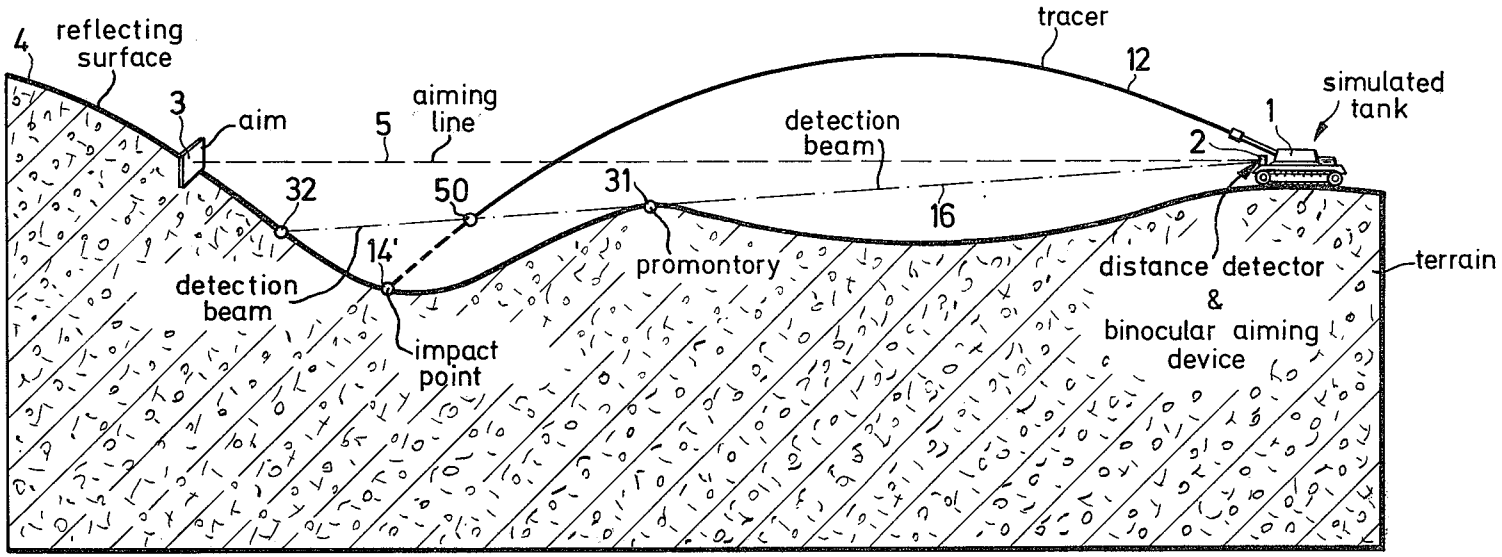
FIG. 2 is a section similar to FIG. 1 wherein, however, the impact point of the imaginary shot on the terrain is not visible from the origin point of the shot.

FIG. 2 shows a system corresponding generally to that of FIG. 1 where once again the tracer or trajectory 12 misses the target 3. Here however the trajectory 12 intersects the terrain 4 at a point 14′ which is hidden from the gunner in the tank 1 by a promontory 31. Thus it is impossible to measure the distance to the point 14′ with the beam 16. It is also impossible for a null zero signal to be produced so that the trajectory 12 slowly traced on the cathode ray tube 25 will go on and pass right through the terrain as seen through the binocular aiming device 2. To avoid this happening the calculator 2 detects the presence of the promontory 31 and interrupts the generation of the video signal in the line 24. The gunner then see a true picture of the shot disappearing behind the promontory 31 since the trajectory 12 is only formed on the screen 25 to a point 50. The computer can do this because the beam 16 is reflected both off the top of the promontory 31 and at a point 32 behind it on the terrain 4. The travel time detector 19 (FIG. 3) therefore receives one right after the other two distance signals which vary considerably. The output signals of the travel time detector 19 are fed to the computer 7 over a line 33 so as to produce the mentioned measured signals.

The deflection angle detector 37 in FIG. 3 consists of a hydraulic cylinder with two pistons the upper of which has a piston rod 46 connected via a crank arm to the axis 52 and the lower of which has a piston rod 48 connected via a crank arm to the rod 55. The pressure in the chamber between these two pistons is equal to the difference in angular position between the optical axes of devices 2 and 15 relative to a horizontal plane. This pressure difference is detected by a piezoelectric strain-gauge detector (not shown) so as to form an electrical signal which is fed over the line 38 to the comparator 35. Instead of this hydraulic arrangement the rod 46 can carry a coil in whose inside there is provided a second coil carried by the rod 48 with the signals produced at the outputs of the coils corresponding to the instantaneous angle $\alpha_i$ formed between the optical axes of the two devices 2 and 15.

The binocular aiming device 2 is produced under the trade name TEM 2A by Karl ZEISS of Oberkochen, West Germany, and is employed in Leopard tanks made by the assignee of this application. The range finder 15 and the thereto-connected travel time detector 19 can be similar to those known in the art and described, for instance, in the German periodical SOLDAT UND TECHNIK, Volume 4, 1973, pages 182–183. The angle detectors 10 and 28 can be of the so-called Resolver type which are constituted as a four-pole DC generator whose rotor is connected to the turning part, here the shafts 56 and 55 respectively. In such angle detectors the stator windings produce a voltage which can be directly related to the angular position of the rotor. Such angle detectors are produced by SIEMENS AG of Munich, West Germany, under the trade name "Drehfeldgeber" (See also Servomechanism Practice, Ahrendt & Savant, McGraw-Hill, New York, (1960) p. 477). The comparators 17 and 35 are standard trade items (See pp. 7–12 ff of Handbook of Telemetry and Remote Control.). In addition to the controller 22 and servomotor 23 are normal devices well known in the art (see pp. 15–20 ff Op. Cit.). Thus all of the components shown in FIG. 3 are commercially available. Details on operation of the range finders and the like and other information about the operation of the components of the system according to this invention can be found in the Handbook of Telemetry and Remote Control edited by E. Gruenberg, (McGraw Hill, 1967).

Figure 4:
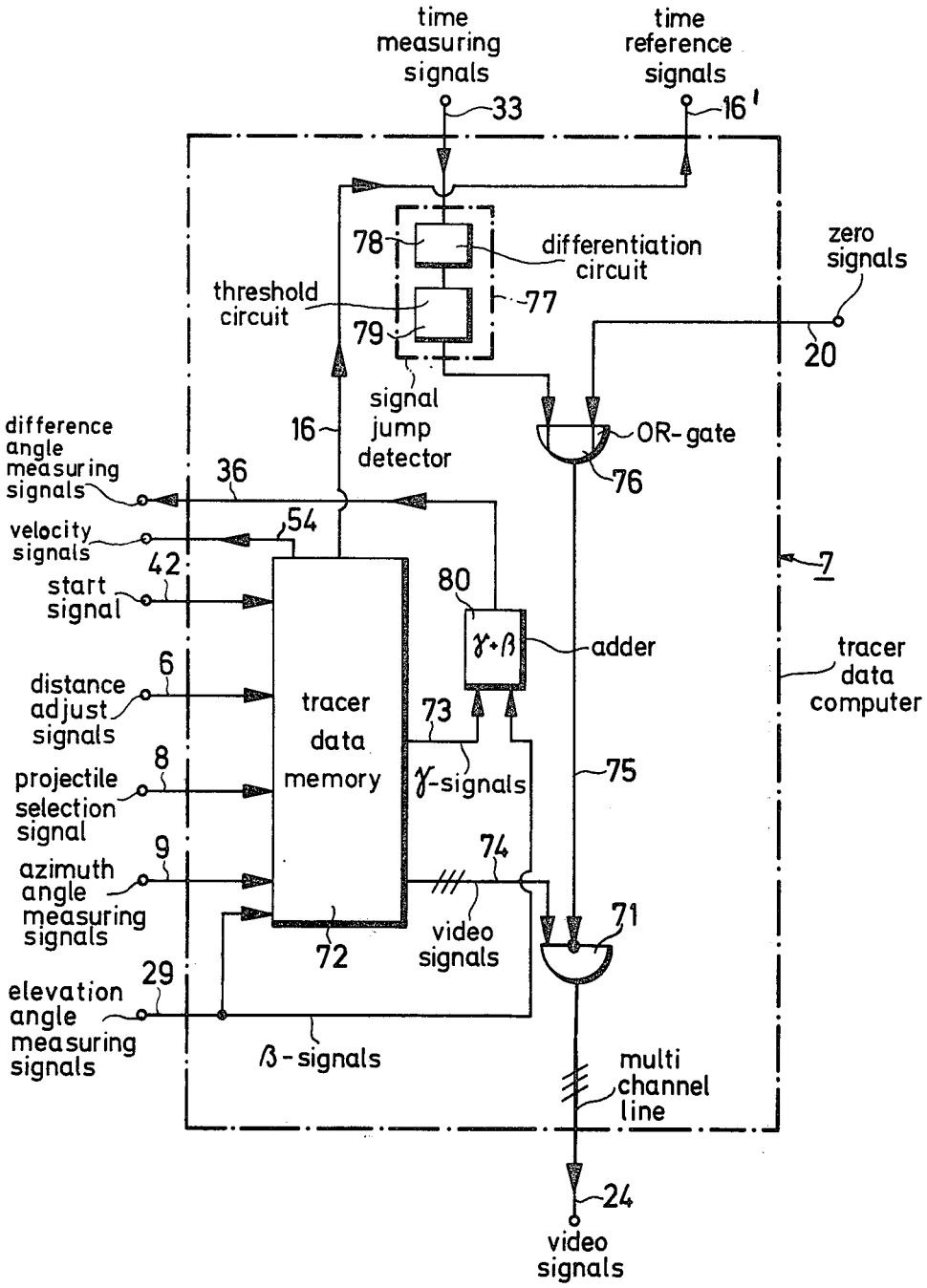
FIG. 4 is a block diagram illustrating the tracer data computer of FIG. 3.

FIG. 4 shows a schematic diagram of the tracer data computer 7 (see pp. 15–67 Op. Cit.) wherein the positions of the connections thereto are shown in the same general array as in FIG. 3. This computer 7 has a memory 72 for the flight path data of the different types of shell (mainly muzzle velocity and wind resistance), this date being corrected according to the information fed at the elevation angle $\beta$, the azimuth angle $\phi$, and the distance E. The flight path data includes the shot speed, the length of the chord between the starting point and the individual locations on the trajectory, the instantaneous angle $\gamma$ of this chord relative to a horizontal plane (see FIG. 1) as well as the coordinates of the trajectory in a polar coordinate system or in a Cartesian coordinate system.

Once the gunner actuates the button 11 and thereby feeds a start signal to the line 42 the information signals in the lines 6, 8, 9, and 29 concerning the flight path data are fed into the memory 72. The data about the chord length is then fed to line 16, the data about the velocity of the shot are fed to line 54, and the data about the position of the trajectory in the form of a video signal are fed by the computer to the multichannel line 74. The number of channels in the line 74 corresponds to the quantity of data fed through this line, as is for example needed to deflect the beam in the tube 25 in the $x$ and $y$ directions as well as to vary the diameter of the beam. The multichannel line 74 leads to the noninverted input of an AND gate 71 (Pulse, Digital and Switching Waveformed, McGraw-Hill, 1965, pp. 317–321) whose inverted input is connected through a line 75 to an OR gate 76 (ibid. pp. 312–317). The first input of the OR gate is directly connected to the line 20 for the zero signals while the second input is connected through a signal-jump detector 77 with the line 33 for the time measuring signals.

The signal-jump detector consists of a series-connected differentiation circuit 78 (ibid. pp. 38 ff.) and a threshold circuit or detector 79 (ibid. pp. 389 ff.). The differentiator 78 continuously detects the slope of the time function described by the time measuring signals, which is discontinuous when a jump in the signal occurs. The threshold of the circuit 79 is set such that it only conducts a signal through from the differentiation circuit 78 when this signal indicates a very steep slope corresponding to a discontinuity in the corresponding time measuring signals in line 33. Any other outputs of the differentiator 78 which correspond to a continuously rising signal in the line 33 cannot pass through the threshold circuit 79. Since the OR gate 76 passes any signal appearing on either of its inputs and feeds them to the inverted input of the AND gate 71 this AND gate will be blocked as soon as the time measuring signal in line 33 is discontinuous or when a zero signal appears in line 20. Until the AND gate is blocked the computer 72 continues to generate the trajectory and feed it via the line 74 to the uninverted inputs of the AND gates 71 whence it can pass outwardly so long as there is no signal in the line 75.

The line 73 to which is fed the data about the chord angle $\gamma$ is fed to the first input of an adder 80 whose second input is directly connected to the line 29 for the actual value signal of the elevation angle $\beta$. The adder 80 sums the signals corresponding to the angles $\beta$ and the $\gamma_i$ so that the summed signal on the output of this adder 80 in line 36 corresponds to the momentary reference value for the differential angle $\alpha_i$ (see FIG. 1). The output of the adder is then connected via the line 36 to the comparator 35 which functions as described above with reference to FIG. 3. The circuit elements in the computer 7 are described as noted, for example, in Pulse, Digital and Switching Waveforms by J. Millman and H. Taub (McGraw Hill: 1965). See also the above-mentioned Handbook of Telemetry and Remote Control at pages 2 — ff and 10 — 1 ff.

I claim:

1. A method of simulating a projectile firing operation comprising the steps of:

automatically and continuously generating and displaying a trajectory trace corresponding to the trajectory of an imaginary projectile from a given starting point over terrain taking into account an estimated distance between the desired impact point and said starting point, the azimuth angle and elevational angle of firing of said projectile, and the characteristic path of the selected projectile type;

training a range finder from a position generally at said starting point through successive points on said trajectory corresponding to instantaneous successive positions of said imaginary projectile thereon and generating first distance signals corresponding to the instantaneous straight-line first distance from said position through said successive points to locations on said terrain;

automatically calculating the instantaneous straight-line second distance between said starting point and said instantaneous successive positions of said imaginary projectile on said trajectory and generating second distance signals corresponding thereto;

comparing said first distance signals with respective second distance signals and generating a zero signal when said first and second distances are equal; and stopping generation of said trace on generation of said zero signal.

2. The method defined in claim 1, further comprising the steps of detecting a discontinuity in said first distance signal and stopping generation of said trace on such detection.

3. The method defined in claim 1 wherein said range finder is trained through said successive points one after the other at a rate corresponding to the rate of travel of said imaginary projectile along said trajectory and said trace is generated at substantially the same rate.

4. The method defined in claim 1, further comprising the steps of:

generating first information signals corresponding to the angle between the optical axis of said range finder and the optical axis of an aiming device directed on said desired impact point;

automatically calculating the angle between the optical axis of said range finder and the optical axis of an aiming device directed on said desired impact point and generating second information signals corresponding thereto;

comparing said generated first and second information signals and producing a difference signal; and positioning said range finder in response to said difference signal.

5. A system for simulating a projectile firing operation comprising:

computer means for automatically and continously generating and displaying a trajectory trace corresponding to the trajectory of an imaginary projectile from a given starting point over terrain taking into account an estimated distance between the desired impact point and said starting point, the azimuth angle and elevational angle of firing of said projectile, and the characteristic path of the selected projectile type;

range-finder means trainable from a position generally at said starting point through successive points on said trajectory corresponding to instantaneous successive positions of said imaginary projectile thereon for generating first distance signals corresponding to the instantaneous straight-line first distance from said position through said successive points to locations on said terrain;

means for automatically calculating the instantaneous straight-line second distance between said starting point and said instantaneous successive positions of said imaginary projectile on said trajectory and generating second distance signals corresponding thereto;

comparator means for comparing said first distance signals with respective second distance signals and generating a zero signal when said first and second distances are equal; and means connected between said computer means and said comparator means for stopping generation of said trace on generation of said zero signal.

6. The system defined in claim 5, further comprising jump detector means for detecting a discontinuity in said first distance signal and stopping generation of said trace on such detection.

7. The system defined in claim 5, further comprising:

an aiming device substantially at said starting point and sightable on said desired impact point;

means for calculating the vertical angle between the optical axis of said aiming device and said range finder means and for generating a first information signal corresponding to said angle;

means for measuring the vertical angle between the optical axis of said aiming device and said range finder means and for generating a second information signal corresponding thereto;

comparator means for comparing said first and second information signals and generating a difference signal corresponding to the difference therebetween, and means connected to said range finder for positioning same in accordance with said difference signal.

8. The system defined in claim 5 wherein said range-finder means includes a semitransparent mirror in its optical axis, said computer means including a cathode-ray tube for displaying said trace adjacent said mirror for superimposing said trace on the image seen through said range-finder means.

9. The system defined in claim 8, further comprising an aiming device pivotal about a vertical axis, and means for holding said range-finder means on said aiming device pivotal jointly therewith about said axis.

* * * * *

UNITED STATES PATENT AND TRADEMARK OFFICE

CERTIFICATE OF CORRECTION

PATENT NO. : 3,965,582

DATED : 29 June 1976

INVENTOR(S) : Gerd von BENNIGSEN

It is certified that error appears in the above-identified patent and that said Letters Patent are hereby corrected as shown below:

In the heading after line [21] replace line [30] by:

-- [30] Foreign Application Priority Data

| | | |
|---|---|---|
| August 2, 1973 | Germany | 2339164 |
| June 11 , 1974 | Belgium | 145281 -- |

Signed and Sealed this

Twenty-third Day of November 1976

[SEAL]

*Attest:*

RUTH C. MASON
*Attesting Officer*

C. MARSHALL DANN
*Commissioner of Patents and Trademarks*